US007783411B2

(12) United States Patent
Asada et al.

(10) Patent No.: US 7,783,411 B2
(45) Date of Patent: Aug. 24, 2010

(54) METHOD OF CONTROLLING FUEL INJECTION AND IGNITION OF AN INTERNAL COMBUSTION ENGINE, USING MONITORED INTAKE PRESSURE

(75) Inventors: Yukihiro Asada, Saitama (JP); Kenichi Machida, Saitama (JP)

(73) Assignee: Honda Motor Co., Ltd., Tokyo (JP)

( * ) Notice: Subject to any disclaimer, the term of this patent is extended or adjusted under 35 U.S.C. 154(b) by 106 days.

(21) Appl. No.: 12/290,981

(22) Filed: Nov. 4, 2008

(65) Prior Publication Data

US 2009/0150048 A1 Jun. 11, 2009

(30) Foreign Application Priority Data

Dec. 7, 2007 (JP) ..... 2007-316994

(51) Int. Cl.
*F02D 41/00* (2006.01)
*F02D 45/00* (2006.01)

(52) U.S. Cl. ..... 701/103; 73/117.03

(58) Field of Classification Search ..... 701/103, 701/29, 99, 101, 102; 73/117.03, 118.01, 73/116

See application file for complete search history.

(56) References Cited

U.S. PATENT DOCUMENTS 6,935,168 B2 * 8/2005 Shimoyama ..... 73/114.28
7,194,898 B2 * 3/2007 Machida et al. ..... 73/114.01

FOREIGN PATENT DOCUMENTS

| | | |
|---|---|---|
| JP | 2541949 | 7/1996 |
| JP | 2004-124879 | 4/2004 |
| JP | 2007-056732 | 3/2007 |
| JP | 2007-182797 | 7/2007 |

* cited by examiner

*Primary Examiner*—Hieu T Vo
(74) *Attorney, Agent, or Firm*—Carrier, Blackman & Associates, P.C.; William D. Blackman; Joseph P. Carrier

(57) ABSTRACT

An engine control method, based on engine intake pressure, is operable to shorten a period from a start of cranking until a sequential fuel injection control is determined. Provisional and final stroke determinations are made for a plurality of cylinders from a synthetic manifold pressure waveform. The provisional stroke determination is made after a crankshaft is rotated 720 degrees after settlement of a crank reference position. The final stroke determination is made when the crankshaft rotates 1440 degrees after the provisional stroke determination. When the provisional stroke determination is made, fuel is injected into the cylinders based on a detected value of the engine intake pressure; and when the stroke determination is finally settled, the fuel injection and ignition of the engine are controlled based on the detected value of the engine intake pressure.

20 Claims, 8 Drawing Sheets

METHOD OF CONTROLLING FUEL INJECTION AND IGNITION OF AN INTERNAL COMBUSTION ENGINE, USING MONITORED INTAKE PRESSURE

CROSS-REFERENCE TO RELATED APPLICATIONS

The present invention claims priority under 35 USC 119 based on Japanese patent application No. 2007-316994, filed on Dec. 7, 2007. The entire disclosure of this priority document, including specification, claims and drawings is incorporated by reference herein.

BACKGROUND OF THE INVENTION

1. Field of the Invention

The present invention relates to an engine control method for controlling fuel injection and ignition of a 4-cycle multi-cylinder internal combustion engine. More particularly, the present invention relates to an engine control method for a multi-cylinder engine, which is based on sensed engine intake pressure, and which is configured to shorten a period from a start of cranking until the fuel injection control is enabled.

2. Description of the Background Art

There is known engine control apparatus having a manifold pressure sensor (a Pb sensor or an intake air pressure sensor) for measuring an engine intake pressure. The engine control apparatus is configured to recognize a pattern of an intake air pressure waveform (a Pb waveform) obtained from engine intake pressure data detected by the Pb sensor, and to carry out a stroke determination for respective cylinders during a starting operation of the engine.

In Japanese published Patent Document JP-A-2007-56732, a fuel injection control apparatus is disclosed, which settles a stroke determination based on a Pb waveform, after approximately three cycles (1 cycle corresponds to 720 degrees of crankshaft rotation) subsequent to starting cranking of the engine. The fuel injection control apparatus of Japanese published Patent Document JP-A-2007-56732 is configured to carry out a group injection, such that fuel is injected simultaneously to synchronous cylinders until the stroke determination is settled. Subsequently, a sequential injection for each cylinder is started.

In a four-cycle engine having four cylinders, a first cylinder group including first and fourth cylinders is operated synchronously, and a second cylinder group including second and third cylinders is operated synchronously, in terms of mechanics and at reverse timing in terms of stroke. For example, when the first cylinder is at a compression top dead center position, the fourth cylinder is at an exhaust top dead center position. Therefore, in the group injection as described above, cylinders which are suitably injected in the intake stroke are two from among all the four cylinders.

However, when influences on exhaust gas or the like are considered, it is preferable to adjust the amount of injection to these two cylinders further to an adequate amount. In order to adjust the amount of injection in the group injection to an adequate amount, it is desirable to control the amount of injection based on the intake air pressure detected by the Pb sensor. An adequate detected value of an intake pressure can easily be obtained from the Pb sensor, even when the throttle opening is low.

Also, since a correspondence between the intake air pressure value detected by the Pb sensor and the crank position in one cycle (720 degrees) is not known until the stroke determination is settled, the value detected by the Pb sensor cannot be immediately used for controlling fuel during starting operation of the engine.

In the disclosure of the Japanese published Patent Document JP-A-2007-56732, approximately three cycles are required from the start of cranking until the stroke determination is settled, and therefore, a period until the fuel injection control is enabled for individual cylinders, based on an intake pressure detected by the Pb sensor, is long. Also, when using a method of starting a calculation of data required for fuel injection control based on the value detected by the Pb sensor after having settled the stroke determination, the period is further elongated.

Although the known engine control methods have some utility for their intended purposes, a need still exists in the art for an improved engine control method. In particular, there is a need for an engine control method which overcomes the difficulties encountered with the known art. Accordingly, it is one of the objects of the present invention to provide an engine control method which solves the problems encountered in the related art, and which, based on sensed engine intake pressure, is configured to shorten the period from the start of cranking until fuel sequential injection control is enabled for individual cylinders.

SUMMARY OF THE INVENTION

In order to achieve the objects, the present invention according to a first aspect of thereof provides an engine control method for carrying out a stroke determination for a plurality of cylinders using a detected value of an engine intake pressure.

The engine control method according to the first aspect thereof includes the steps of providing a period for provisionally settling the stroke determination using a first method of determination with a first (lower) degree of accuracy; finally settling said stroke determination using a second method of determination with a second (higher) degree of accuracy; when the stroke determination is provisionally settled, carrying out fuel injection control of an engine based on the detected value of the intake pressure; and when the stroke determination is finally settled, carrying out the fuel injection control and the ignition control of the engine based on the detected value of the intake pressure.

A second aspect of the present invention is characterized in that the provisional settlement of said stroke determination is achieved by repeating a pattern recognition of the waveform of the intake pressure by a first predetermined number of times; and the final settlement of said stroke determination is achieved by repeating a pattern recognition of a waveform of the intake pressure by a second predetermined number of times, The first predetermined number of times is less than the second predetermined number of times.

A third aspect of the present invention is characterized in that when the stroke determination is provisionally settled, a group injection for injecting fuel to synchronous cylinders simultaneously based on the detected value of the intake pressure is carried out, and, when the stroke determination is finally settled, a sequential injection for injecting fuel for each cylinder is carried out based on the detected value of the intake pressure.

A fourth aspect of the present invention is characterized in that buffering of the detected values of the intake pressure is carried out from the start of cranking of the engine, in that the stroke determination is provisionally settled at a time point when the crankshaft has rotated by 720 degrees from a time point when a crank reference position of the engine is settled;

and when the stroke determination is provisionally settled, the buffered detected values of the intake pressure are related to provisional cycle stages turned out in the provisional settlement, so that the fuel injection control using the buffered detected values of the intake pressure is enabled at a time point of the provisional settlement.

A fifth aspect of the present invention further includes an idle air control valve (IACV) for controlling the number of idling revolutions of the engine, and an IACV control unit for controlling the same. The fifth aspect of the present invention is characterized in that the IACV control unit is set to carry out an initial processing for driving the IACV once to a fully opened position at a time point when an ignition switch is turned ON.

ADVANTAGES OF THE METHOD ACCORDING TO THE INVENTION

According to the first aspect of the present invention, the engine control method includes providing the period for provisionally settling the stroke determination using the first method of determination with a lower degree of accuracy than finally settling the stroke determination using the second method of determination with a higher degree of accuracy. Accordingly, when the stroke determination is provisionally settled, the fuel injection control of the engine is carried out based on the detected value of the intake pressure, and when the stroke determination is finally settled, the fuel injection control and the ignition control of the engine are carried out based on the detected value of the intake pressure.

Therefore, the fuel injection control based on the intake pressure of the engine is enabled at a time point of the provisional settlement before the stroke determination is finally settled. Accordingly, an evaporated state of the fuel at the time of engine start can be adjusted to a further adequate state in comparison with the case in which the fuel injection control is carried out based on the throttle opening. After the stroke determination is finally settled, the fuel injection control and the ignition control can be carried out based on the intake pressure of the engine.

According to the second aspect of the present invention, the final settlement is achieved by repeating the pattern recognition of a waveform of the intake pressure by the second predetermined number of times, and the provisional settlement is achieved by repeating the pattern recognition of the intake pressure by the first number of times, which is less than the second predetermined number of times. Therefore, the provisional settlement of the stroke determination can be easily carried out without using a specific method.

According to the third aspect of the present invention, when the stroke determination is provisionally settled, a group injection for injecting fuel to synchronous cylinders simultaneously based on the detected value of the intake pressure is carried out. When the stroke determination is finally settled, a sequential injection for injecting fuel for each cylinder based on the detected value of the intake pressure is carried out.

Therefore, the group injection to be carried out before the stroke determination is finally settled can be carried out with an amount of injection with higher adequacy and accuracy compared to a method of carrying out the fuel injection control with the throttle opening as a parameter. The injection can be transferred quickly to the sequential injection based on the detected value of the intake pressure in association with the final settlement of the stroke determination.

According to the fourth aspect of the present invention, buffering of the detected values of the intake pressure is carried out from the start of cranking of the engine, in that the stroke determination is provisionally settled at a time point when the crankshaft has rotated by 720 degrees from a time point when the crank reference position of the engine is settled. When the stroke determination is provisionally settled, the buffered detected values of the intake pressure are related to provisional cycle stages turned out in the provisional settlement, so that the fuel injection control using the buffered detected values of the intake pressure is enabled at a time point of the provisional settlement.

Therefore, the fuel injection control based on the intake pressure of the engine is enabled at a time point when the crankshaft has rotated by 720 degrees after the crank reference position is settled and the stroke determination is provisionally settled, so that the evaporated state of the fuel at the time of engine start can be adjusted to an adequate state from an earlier stage.

According to the fifth aspect of the present invention, the idle air control valve for controlling the number of idling revolutions of the engine, and the IACV control unit for controlling the same are provided, and the IACV control unit is configured to carry out an initializing process for driving the idle air control valve once to a fully opened position at a time point when the ignition switch is turned ON.

Therefore, the engine control method which completes the initializing process for the idle air control value in a shortest possible period, and maintains an adequate evaporated state of fuel even when the cranking is started immediately after turning the ignition switch ON and hence the intake pressure of the engine for the initializing process varies is obtained.

For a more complete understanding of the present invention, the reader is referred to the following detailed description section, which should be read in conjunction with the accompanying drawings. Throughout the following detailed description and in the drawings, like numbers refer to like parts.

DETAILED DESCRIPTION OF ILLUSTRATIVE EMBODIMENTS

It should be understood that only structures considered necessary for illustrating selected embodiments of the present invention are described herein. Other conventional structures, and those of ancillary and auxiliary components of the system, will be known and understood by those skilled in the art.

Figure 1:
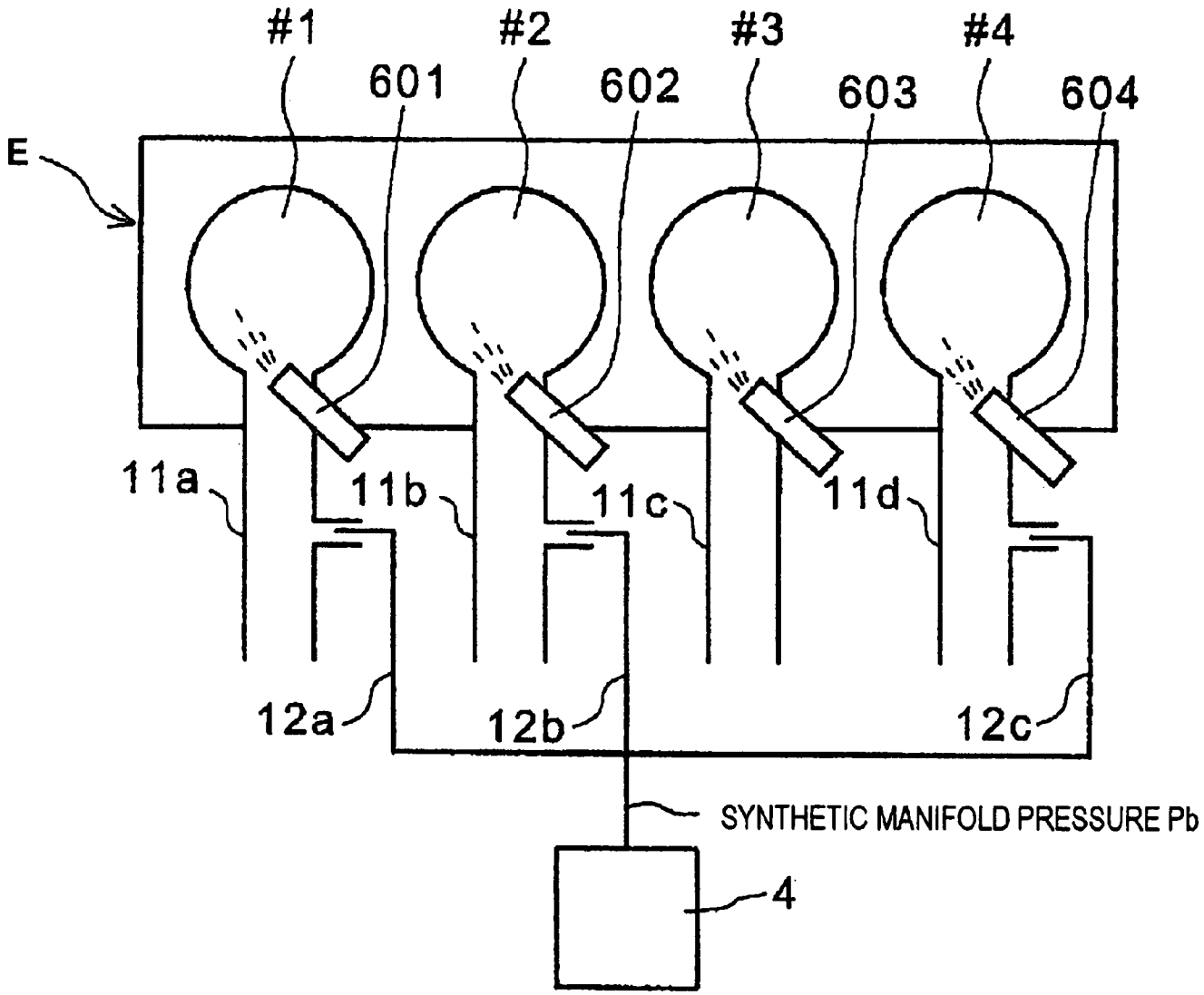
FIG. 1 is an explanatory schematic drawing illustrating a four-cycle four-cylinder engine to which an engine control method according to an illustrative embodiment of the present invention is applied.

Referring now to the drawings, selected illustrative embodiments of the present invention are described in detail. FIG. 1 is a schematic explanatory drawing illustrating a four-cycle, four-cylinder engine E which is operated using an engine control method according to an illustrative embodiment of the present invention.

The four-cycle four-cylinder engine E includes a first cylinder #1, a second cylinder #2, a third cylinder #3 and a fourth cylinder #4. The first through fourth cylinders #1-#4 of the engine E are respectively formed with intake pipes 11*a* to 11*d*, each of which extends to a corresponding respective intake port of the cylinders #1-#4. The intake pipes 11*a*, 11*b*, and 11*d* of cylinders #1, #2, and #4 are respectively provided with independent passages 12*a*, 12*b* and 12*c*, arranged in a manner such that one end of each of these passages communicates with a corresponding one of the intake pipes 11*a*, 11*b*, and 11*d* respectively.

The intake pipes 11*a*, 11*b*, 11*c* and 11*d* are respectively provided with fuel injection valves 601, 602, 603 and 604 for injecting controlled amounts of fuel into each of the respective cylinders. An intake pressure sensor (Pb sensor) 4 joins the other ends of the passages 12*a*, 12*b* and 12*c* of the first, second, and fourth cylinders, and detects a synthetic manifold pressure Pb obtained by combining the intake pressures generated in the individual intake pipes 11*a*, 11*b*, and 11*d* of the first, second, and fourth cylinders #1, #2 and #4.

Since the shapes of waveforms of the synthetic manifold pressure Pb generated during a first turn of a crankshaft and a second turn thereof are different, the stroke of the engine can be determined by analyzing the Pb waveforms.

Figure 2:
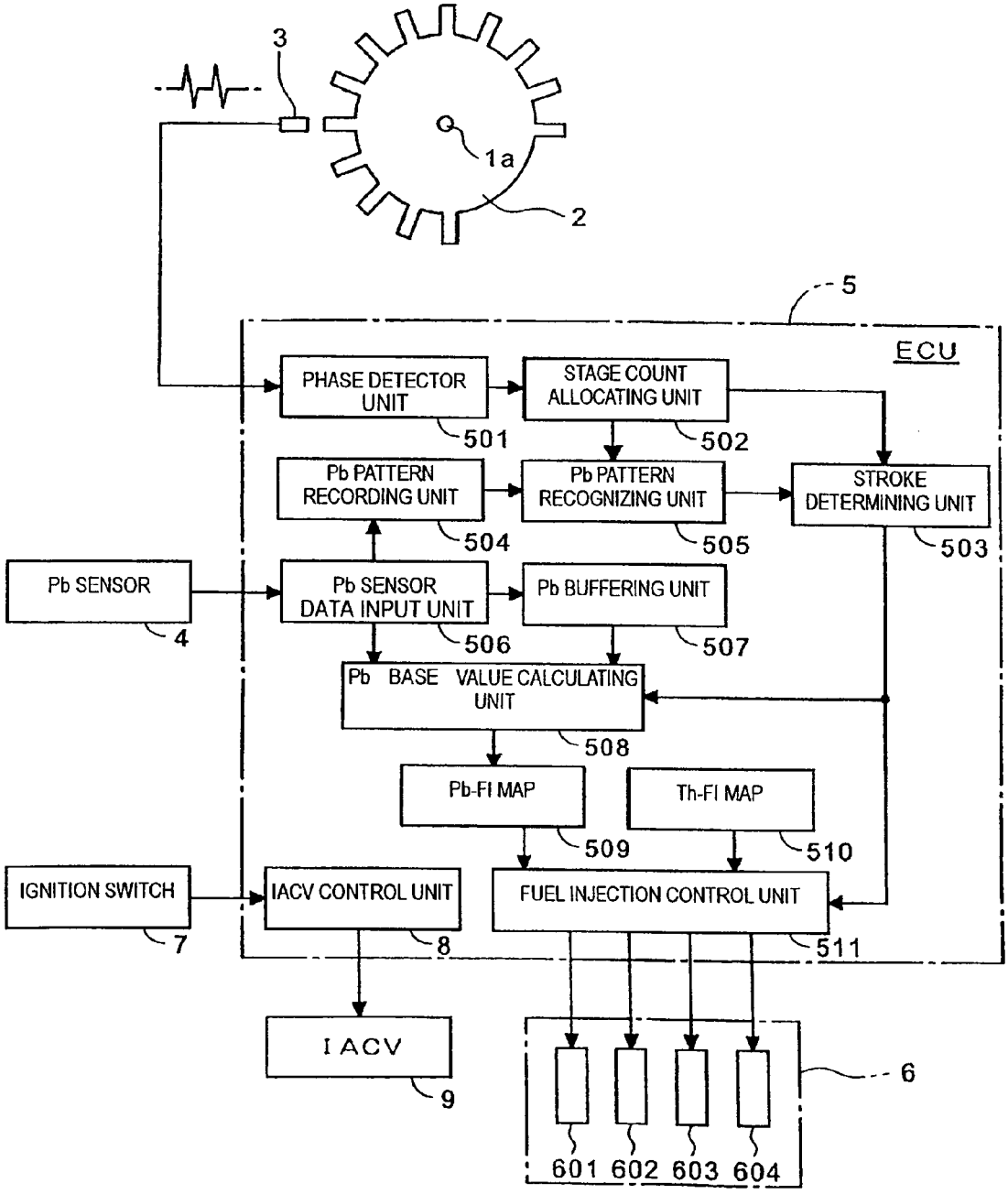
FIG. 2 is a block diagram showing a configuration of an engine control apparatus which implements the engine control method according to the illustrative embodiment of the present invention.

FIG. 2 is a block diagram showing an engine control apparatus which implements an engine control method according to the illustrative embodiment of the present invention. A crankshaft 1*a* of the engine 1 is provided with a crank pulser rotor 2 and a pulse generator 3. The crank pulser rotor 2 has thirteen projections, and also includes an open portion without any projection, so that thirteen crank pulses are outputted per rotation of the rotor.

The thirteen projections are arranged around the crank pulser rotor 2 at intervals of 22.5 degrees, and the portion of the crank pulser rotor 2 having no projection extends for 90 degrees around the rotor, as shown. The crank pulses, as well as output signals from the Pb sensor 4, are entered to an ECU 5 together with other sensor signals, engine operating conditions and the like.

The output signals from the pulse generator 3 are entered into a phase detector unit 501 for detecting the phase of the crankshaft 1*a* based on the crank pulses. A stage count allocating unit 502 divides one turn of the crankshaft at output timing of crank pulses into thirteen parts, and allocates cranking stages from "0" to "12" to the respective phases (cranking stages out of 360 degrees rotation) of the crankshaft.

The output signals from the Pb sensor 4 are entered to a Pb sensor input data unit 506, and the variation pattern of the synthetic manifold pressure Pb is recorded in a Pb pattern recording unit 504.

A Pb pattern recognizing unit 505 compares and recognizes variation in pattern of the recorded synthetic manifold pressure Pb and a stored predetermined Pb pattern. A stroke determining unit 503 carries out a stroke determination of the engine, based on the allocation of the cranking stages and the result of recognition of the Pb pattern.

The Pb values for each of the cranking stages, sensed by the Pb sensor input data unit 506, are recorded temporarily on a Pb buffering unit 507. The result sensed by the Pb sensor input data unit 506 is entered into a Pb base value calculating unit 508 for calculating a Pb base value required for using a Pb—FI map 509 for deriving the amount of fuel injection required based on the intake pressure of the engine.

The Pb base value calculating unit 508 selects a receiver of original data for calculating the Pb base value based on the result of the stroke determination from the Pb sensor input data unit 506 or the Pb buffering unit 507. The Pb base value is described in further detail later herein.

A fuel injection control unit 511 controls opening and closing of the fuel injection valves 601, 602, 603 and 604 of a fuel injection device 6. The fuel injection control unit 511 is adapted to receive information on the amount of fuel injection from a Th—FI map 510, which derives the amount of fuel injection based on the values detected by a throttle opening sensor, or the Pb—FI map 509 based on the result of the stroke determination.

The engine 1 according to the illustrative embodiment is provided with an idle air control valve (IACV) 9, provided on a bypass conduit (not shown) communicating with the intake pipes 11*a*-11*d* of the engine 1, for controlling the number of idling revolutions by varying an amount of intake air separately from air passing through a throttle valve driven by an actuator or the like.

An ECU 5 is provided with an IACV control unit 8 for controlling the IACV 9. The IACV control unit 8 is set to carry out an initializing process for initializing drive position data by driving the IACV 9 once to a fully opened position when the ignition switch 7 is turned ON for starting the engine.

Figure 3:
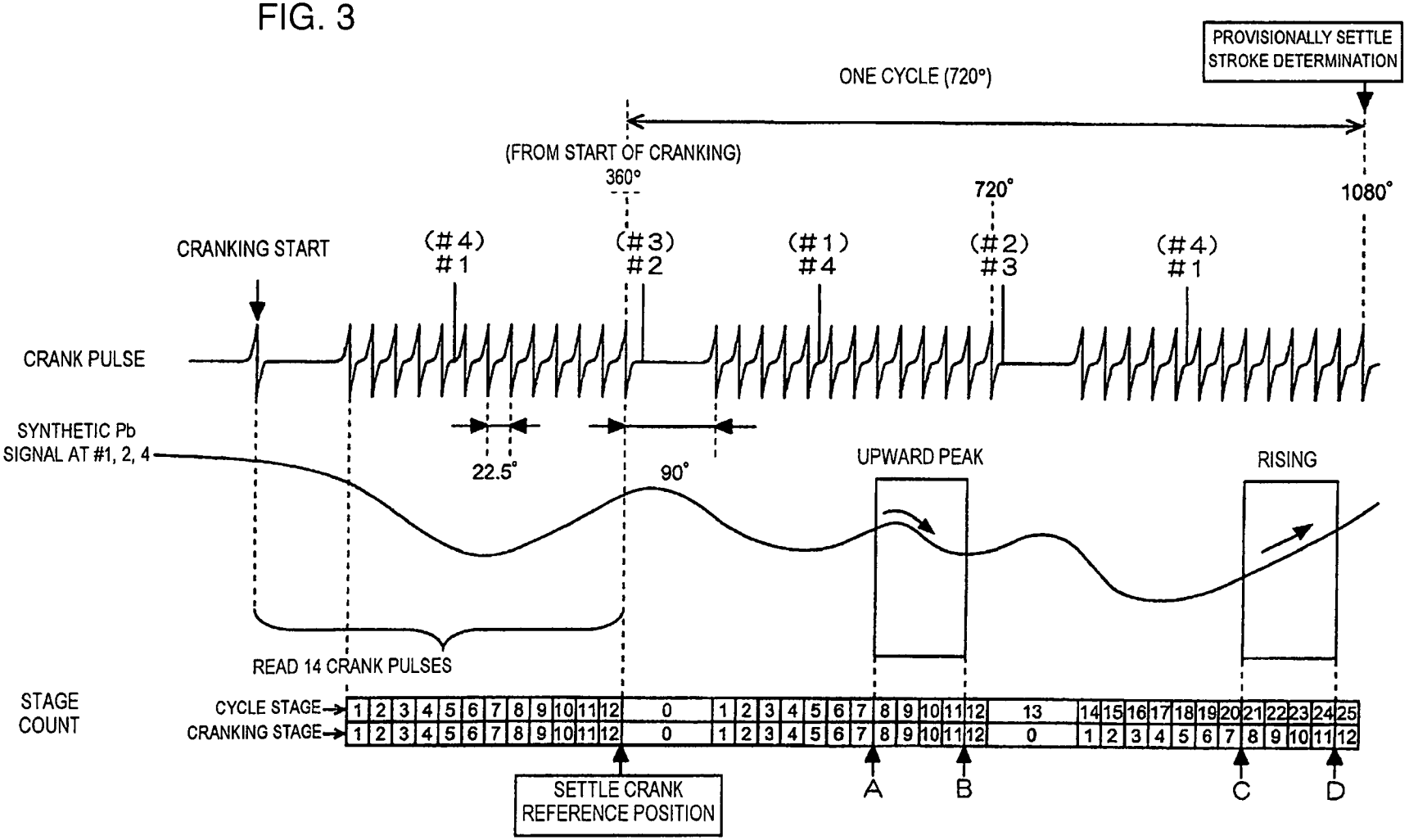
FIG. 3 is a timing chart showing the relation between a cranking angle and a waveform of a synthetic manifold pressure.

FIG. 3 is a timing chart showing a relationship between the cranking angle and the waveform of the synthetic manifold pressure Pb. When the cranking is started for starting the engine, the phase detector unit 501 (see FIG. 2) starts detecting the crank pulses. In the illustrative embodiment, a crank reference position is settled at a time point when fourteen crank pulses have been detected, and allocation of the cranking stages is enabled. The portion of the crank pulser rotor 2 having no projection, which serves as a reference point for the rotational position, passes the pulse generator 3 at some point without fail during rotation of the rotor while the fourteen crank pulses are being detected. In the drawing, the cranking stages until the crank reference position is settled are shown for the convenience of explanation.

In the illustrative embodiment, the stroke determination is carried out by recognizing the pattern of the waveforms of the synthetic manifold pressure Pb of the first, second, and fourth cylinders #1, #2 and #3 by the Pb pattern recognizing unit 505. The pattern recognition is carried out between the cranking stages (360 degree stage) 8 to 11, that is, in an A-B section (first turn) and a C-D section (second turn). The Pb pattern recognizing process is carried out by identifying the waveform pattern of the synthetic manifold pressure Pb in two patterns of "upward peak" having an inflection point and "rising" having no inflection point.

The Pb pattern in the A-B section is recognized as an "upward peak" and the Pb pattern in the subsequent C-D section is recognized as a "rising". Subsequently, the Pb pattern repeats the "upward peak" and the "rising" alternately as long as the engine 1 is in normal operation, and hence the stroke determination can be settled at a time point when the number of times of the continuous recognition of the Pb pattern reaches a predetermined number of times.

For example, when the predetermined number of times is set to six times, recognition of the two patterns of the "upward peak" and the "rising" is carried out three times repeatedly, so that the result of stroke determination with a higher degree (a second degree) of accuracy is obtained.

In the example illustrated in FIG. 3, the number of times of continuous recognition of the Pb pattern reaches twice at a timing when the crankshaft has rotated by 1 cycle (720 degrees) from a time point when the crank reference position is settled. Therefore, when the predetermined number of times is set to six, four more times of continuous recognition of the Pb pattern is necessary, the stroke determination is settled after about three cycles after the crank reference position is settled.

Although, which one of the compression top dead centers of the first to fourth cylinders indicated by # signs indicated in two rows above the crank pulse in the drawing is correct, that is, how they are recognized in terms of the phase of the crankshaft expressed in 360 degrees front and reverse has been unknown before the stroke determination has settled, it was found that the upper row with parenthesis corresponds to the front, and the lower row without parenthesis corresponds to the reverse when the stroke determination is settled.

When the stroke determination is settled, the sequential fuel injection control and the ignition control can be carried out independently for each cylinder.

The fuel injection control unit 511 controls the group injection such that fuel is injected simultaneously in the synchronous cylinders until the stroke determination is settled, and the sequential injection for each cylinder is started. In general, the amount of injection at the time of the group injection is derived from the Th—FI map based on a parameter, such as a throttle opening.

However, when the adjustment of the amount of injection to an adequate amount is considered, it is preferable to use the Pb—FI map for deriving the amount of injection from a value detected by the Pb sensor, which is capable of obtaining an optimal value easily even when the throttle opening is low. Since the corresponding relationship between the value detected by the Pb sensor and the cycle stages (720 degrees stage) is unknown until the stroke determination is settled, the value detected by the Pb sensor cannot be used until the such time as the stroke is determined.

In the ignition control, the group ignition, such that the synchronous cylinders are simultaneously ignited, is carried out until the stroke determination is settled. However, in the group ignition, since a slight displacement of a spark advance significantly affects the combustion state of the engine, it is preferable to start control based on the value detected by the Pb sensor after the stroke determination has been settled.

In contrast, in the case of the fuel injection control, since only the amount of injection is different even when the front and reverse of the stroke are recognized, serious problems do not occur. Therefore, the engine control apparatus according to the present invention is characterized in that a period for provisionally settling using a first method of determination with lower degree (a first degree) of accuracy in comparison with the final settlement is provided before finally settling the stroke determination using a second method of determination with a higher degree (a second degree) of accuracy. When the stroke determination is provisionally settled, the fuel injection control is started at a time point based on the value detected by the Pb sensor.

In the example shown in FIG. 3, it is required to provisionally set the stroke determination at a time point when the crankshaft is rotated by 360 degrees from the start of cranking and the crank reference position is settled, and then the crankshaft is rotated another complete cycle (720 degrees).

This provisional settling is carried out based on the order (1: upper peak, 2: rising) of the Pb pattern continuously recognized during one cycle after having settled the crank reference position. With such provisional settlement, 0 to 25 cycle stages (720 degrees stage) with respect to 0 to 12 cranking stages (360 degrees stage) are provisionally settled.

In the illustrative embodiment, it is required to finally settle the stroke determination at a time point when the above-described number of times of the continuous recognition reaches to six. In the illustrative embodiment described above, the timings of decision of the provisional settlement and the final settlement are determined based on the number of cycles of the rotation from the crank reference position. However, it may be based on a time point when the predetermined ordinal number of Pb pattern recognition is completed.

Figure 4:
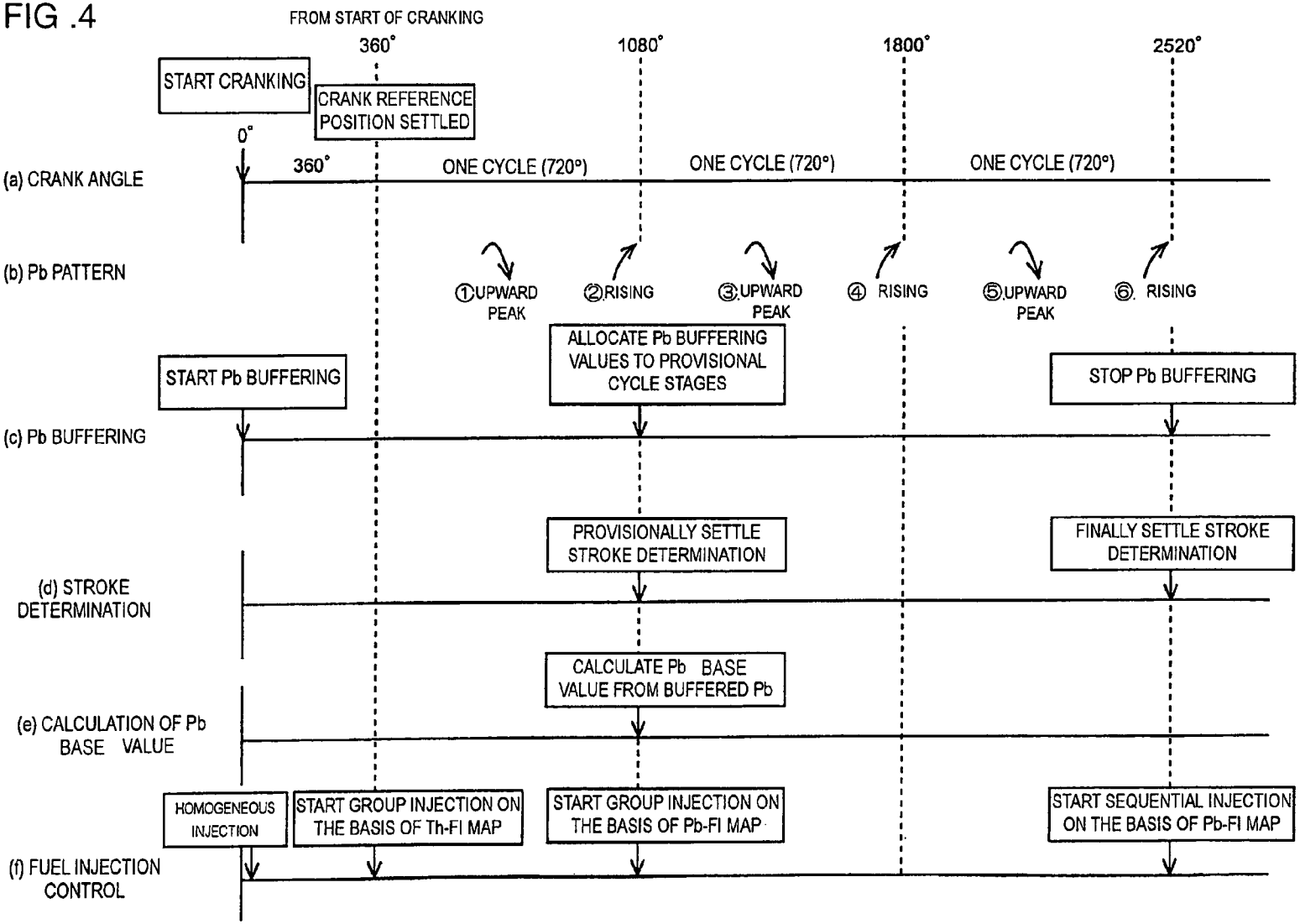
FIG. 4 is a time chart showing the relationship between a crank angle from a start of cranking and various processes performed during starting of the engine.
Figure 5:
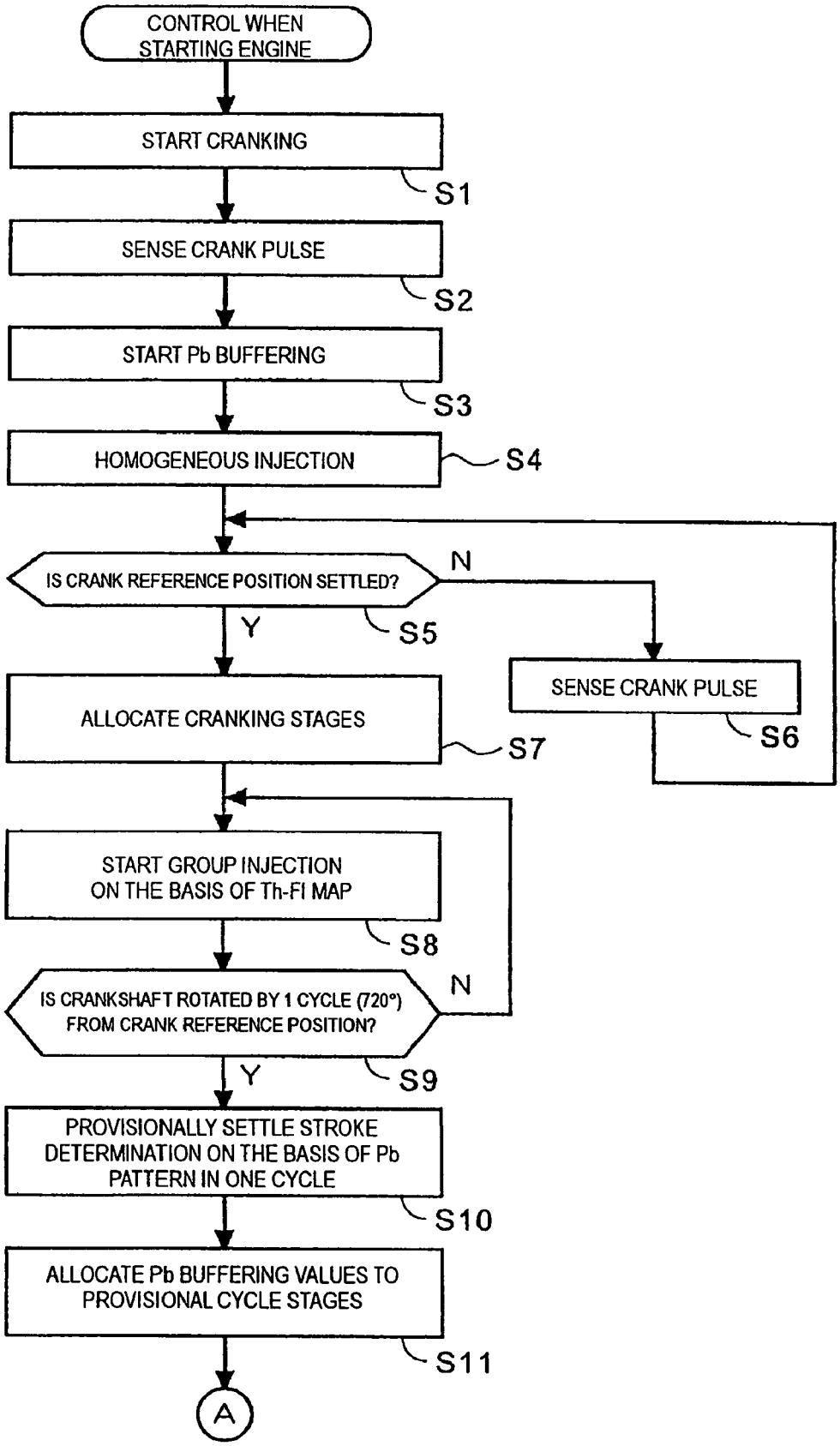
FIG. 5 is a flowchart (main flow 1) showing a flow of control when starting the engine according to the illustrative embodiment.
Figure 6:
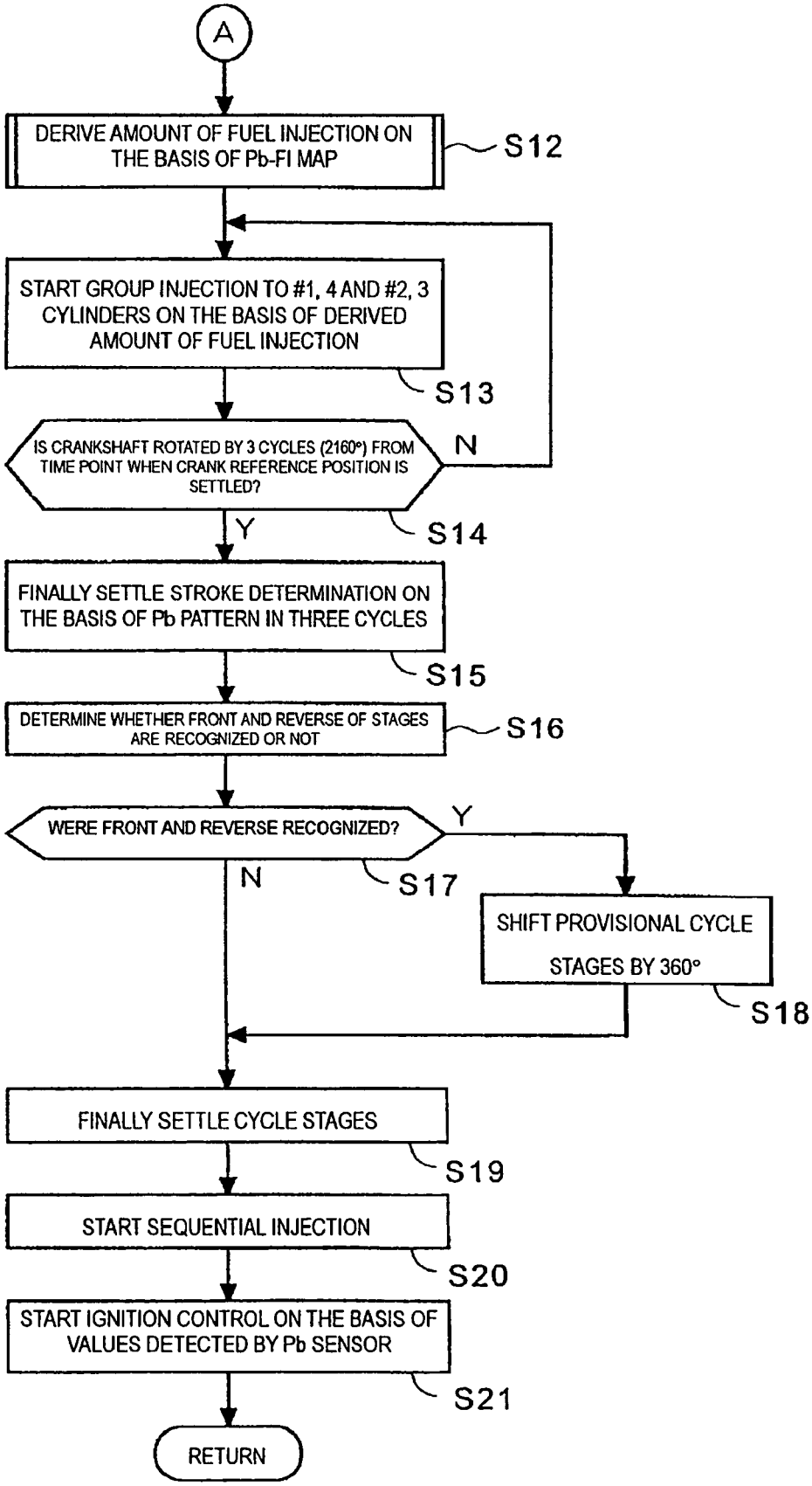
FIG. 6 is a flowchart (main flow 2) showing continuation of the flow of control of FIG. 5 when starting the engine according to the illustrative embodiment.
Figure 7:
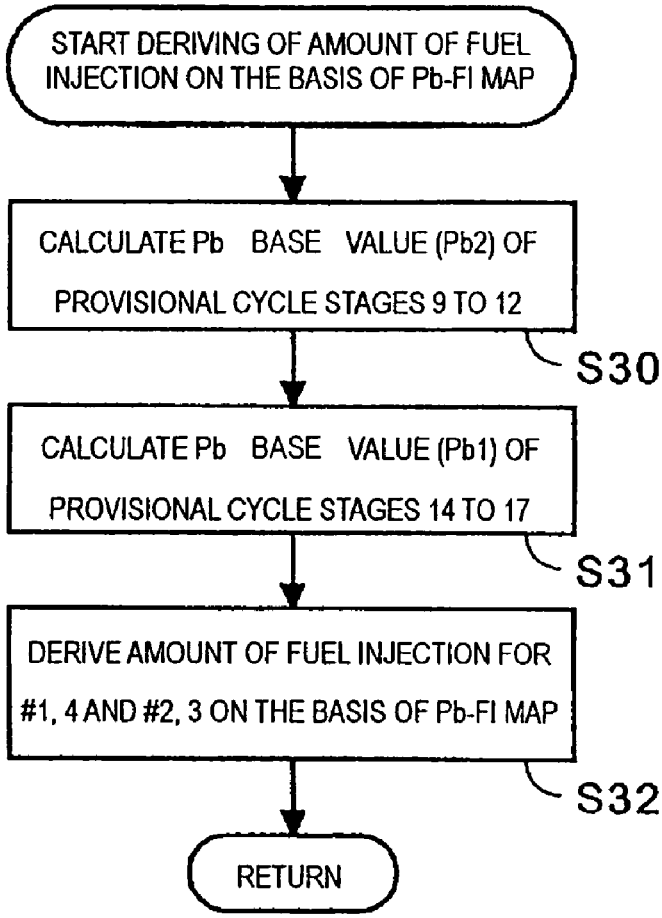
FIG. 7 is a flowchart showing a flow of process for deriving an amount of fuel injection based on a Pb—FI map.

Referring now to a time chart in FIG. 4 and flowcharts in FIGS. 5 through 7, an operation of the engine control apparatus according to the illustrative embodiment of the present invention from the start of cranking is described.

FIG. 4 is a time chart showing a relationship between the crank angle and the various processes from the start of cranking. From the upper row, states of (a) crank angle, (b) Pb pattern, (c) Pb buffering, (d) stroke determination, (e) calculation of Pb base value, and (f) fuel injection control are shown respectively. As described above, the engine control apparatus according to the illustrative embodiment is configured to provisionally settle the stroke determination at a time point when the crankshaft is rotated by one cycle from the settlement of the crank reference position, and in association with this provisional settlement, fuel injection control is started based on the values detected by the Pb sensor.

Further specifically, the engine control apparatus is configured to switch the map used for the fuel injection control from the Th—FI map 510 to the Pb—FI map 509 (see FIG. 2) at a time point when the stroke determination is provisionally settled. The engine control apparatus enables switching to the Pb—FI map 509 immediately at a time point when the stroke determination is provisionally settled. The engine control apparatus is configured to calculate data (Pb base value) for entering into the Pb—FI map 509 using the previously Pb detected values stored in the Pb buffering unit 507.

FIGS. 5 through 7 are flowcharts showing a flow of control when starting the engine according to the illustrative embodiment. When the cranking of the engine is started in Step S1, the phase detector 501 detects the crank pulses (see FIG. 2) in Step S2. In a subsequent Step S3, the Pb buffering unit 507 starts buffering of the Pb detected values for the respective cranking stages. In Step S4, homogeneous injection for injecting fuel to all the four cylinders simultaneously is carried out. The homogeneous injection is a process for injecting fuel required for starting the engine in association with the detection of the crank pulse irrespective of the crank position.

In Step S5, whether the crank reference position is settled or not is determined. In the illustrative embodiment, the crank reference position is settled at a time point when the fourteen crank pulses are detected, and procedure advances to Step S7. As shown in FIG. 3, in the illustrative embodiment, since it is assumed that the first crank pulse is detected when the cranking is started, the crank reference position is settled at a time point when the crankshaft is rotated by 360 degrees after having started the cranking.

However, when a predetermined time interval is required until the first pulse is detected after having started the cranking, the period until the cranking reference position is settled is postponed correspondingly. The settlement of the crank reference position may be carried out at a time point when the crankshaft is rotated by 720 degrees after having started the cranking, or at a time point when the portion of the pulser rotor having no projection passes twice. When the negative determination is made in Step S5, the procedure advances to Step S6, where the sensing of the crank pulses is continued, and returns back to the determination in Step S5 again.

In Step S7, the stage count allocating unit 502 allocates the cranking stages from 0 to 12. In subsequent Step S8, the group injection is started based on the Th—FI map 510 for deriving the amount of injection using the throttle opening, as one of the parameters. The group injection is enabled because the cranking stage (360 degrees stage) is turned out by the settlement of the crank reference position. Accordingly, the injection in the intake stroke for two cylinders from among the four cylinders is ensured.

In Step S9, whether the crankshaft is rotated from the crank reference position by 1 cycle (720 degrees) or not is determined, and when the determination is affirmative, the procedure goes to Step S10, where the stroke determination is provisionally settled based on the Pb pattern (1: upper peak, 2: rising) in one cycle. When the determination is negative in Step S9, the procedure goes back to Step S8, where the group injection based on the Th—FI map 510 is carried out in the predetermined cranking stage.

Subsequently, when the stroke determination is provisionally settled, a plurality of steps is performed in order to carry out the group injection based on the Pb—FI map 509. In Step S11, the Pb buffering values are allocated to the provisionally settled cycle stages. With these processes, the Pb detected values stored temporarily in the Pb buffering unit 507 become available simultaneously with the provisional settlement of the stroke determination.

Subsequently, intake pressure data to be entered into the Pb—FI map 509 is calculated based on the Pb detected values in two cycles corresponding to the provisional cycle stages. In Step S12, the amount of fuel injection based on the Pb—FI map 509 is derived. Intake pressure data entered into the Pb—FI map 509, described above, are maximum values (Pb base values) of the intake negative pressure measured in the predetermined range in the provisional cycle stages.

Figure 8:
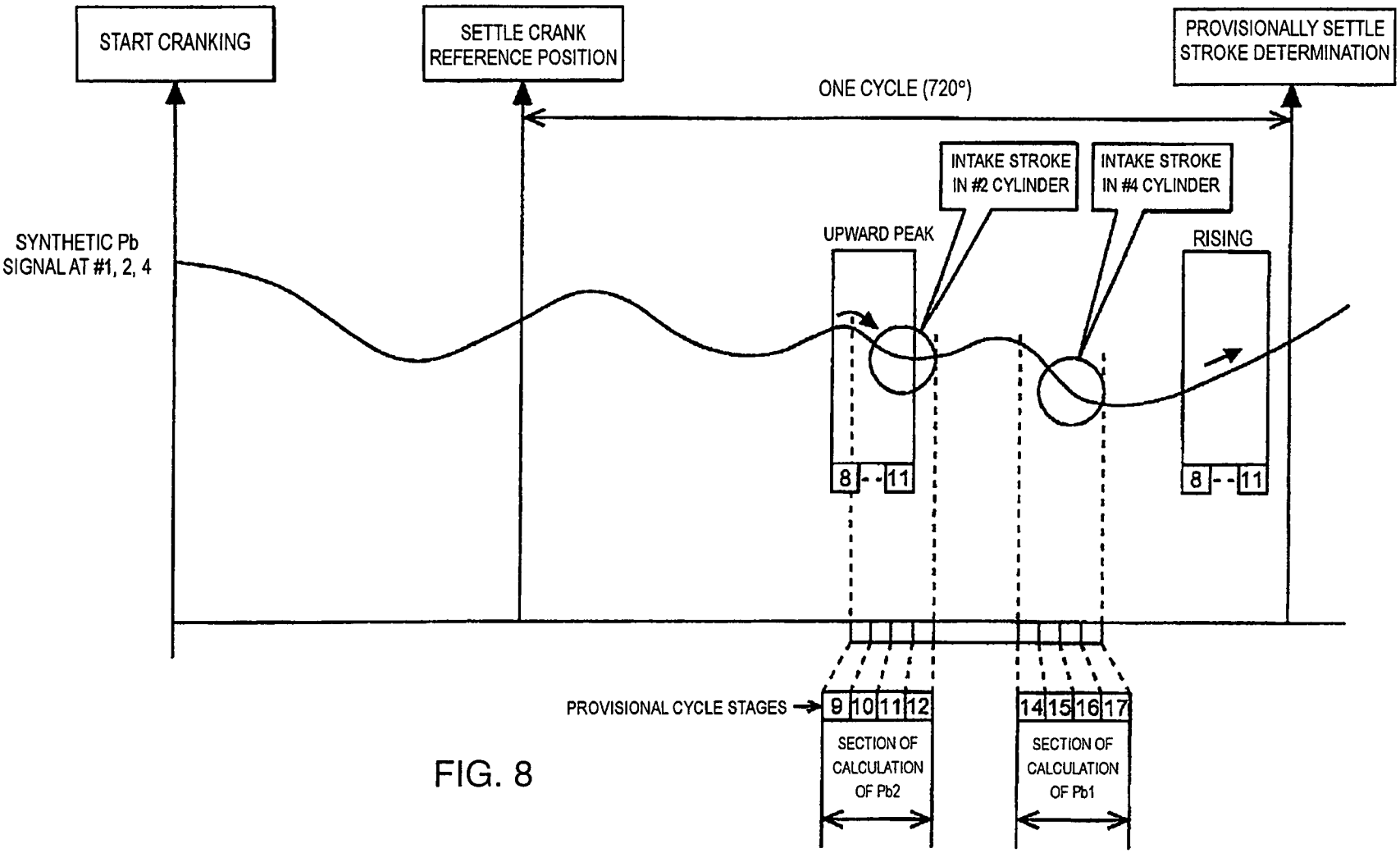
FIG. 8 is a graph showing the relationship between a Pb waveform and a calculating period of a Pb base value.

FIG. 8 is a graph showing a relationship between the waveform of the synthetic manifold pressure Pb and the calculating period of the Pb base value. When the stroke determination is provisionally settled, the position of the intake stroke in the each cylinder is turned out. Therefore, the positional relation with respect to the waveform and the synthetic manifold pressure Pb is also turned out. Accordingly, in the illustrative embodiment, it is expected that a Pb base value Pb2 of the intake stroke of the second cylinder is present within the range of the provisional cycle stages 9 to 12, and a Pb base value Pb1 of the intake stroke of the fourth cylinder is present in the range of the provisional cycle stages 14 to 17.

As shown in a sub-flow of FIG. 7, in Step S30, the Pb base value Pb2 in the provisional cycle stages 9-12 is calculated. The Pb2 is used for the group injection of the second and third cylinders. Subsequently, in Step S31, the Pb base value Pb1 in the provisional cycle stages 14 to 17 is calculated. The Pb1 is used for the group injection of the first and fourth cylinders. In Step S32, the calculated Pb1 and Pb2 are entered respectively into the Pb—FI map to derive the amount of injection in the group injection.

Referring to the flowchart in FIG. 6, in Step S13, the group injection to the first and fourth cylinders, and the second and third cylinder is started based on the amount of fuel injection derived from the Pb—FI map 509. The fuel injection for the same group of cylinders is once per 720 degrees in angle of crank rotation.

When the stroke determination is finally settled after having repeated the group injection, the injection is transferred in sequence to the sequential injection for injecting fuel so as to match the timing of the intake stroke of the each cylinder. In this manner, by buffering the values detected by the Pb sensor, the engine control apparatus of the present invention applies the Pb—FI map 509 at the time point when the stroke determination is provisionally settled.

In Step S14, whether or not the crankshaft has rotated by three cycles (2160 degrees) from a time point when the crank reference position is settled is determined. When the determination is affirmative, the procedure advances to Step S15, where the stroke determination is finally settled. As described above, this final settlement is based on the Pb pattern recognition during the three cycles after having settled the crank reference position. When the determination is negative in Step S14, the procedure goes back to Step S13.

In subsequent Step S16, determination of whether or not the front and reverse of the stages are recognized is carried out in association with the final settlement of the stroke determination. Accordingly, when the result of the provisional settlement is found to be correct, the negative determination is given in Step S17, and the procedure advances to Step S19, where the cycle stages are finally settled without change.

When the determination in Step S17 is affirmative, that is, when it is determined that the front and reverse are recognized, the procedure advances to Step S18, where the value of the provisional cycle stages are shifted by 360 degrees.

In other words, the front and reverse are reversed, so that the correct cycle stages are obtained. At this time, the cycle stages allocated to the Pb buffering unit are reversed simultaneously. The Pb buffering shown in FIG. 4 is stopped at the time point when the stroke determination is finally settled.

Subsequently, in Step S20, in association with the final settlement of the stroke determination, the sequential injection based on the Pb—FI map 509 is started and, in Step S21, the ignition control based on the value detected by the Pb sensor is also started, so that a series of controls is ended.

As described above, according to the engine control apparatus in the present invention, since the stroke determination is provisionally settled at a time point when the crank is rotated by one cycle from a time point when the crank reference position is settled, and the Pb—FI map is enabled based on the result of the provisional settlement, the fuel injection control based on the value detected by the Pb sensor at a time point when the stroke determination is provisionally settled can be started.

Accordingly, the period from the start of cranking until when the fuel injection control based on the value detected by the Pb sensor is enabled can be shortened. The group injection carried out from the provisional settlement to the final settlement of the stroke determination is controlled based on the value detected by the Pb sensor, so that adjustment of the evaporated state of the fuel by the group injection to an adequate state is achieved.

In this manner, according to the engine control apparatus in the illustrative embodiment, the fuel injection control based on the value detected by the Pb sensor is enabled at a time point when the stroke determination is provisionally settled.

However, as shown in FIG. 2, in the engine provided with the IACV (idle air control valve) 9, still another advantage may be achieved.

As described above, the IACV control unit 8 in this embodiment is adapted to carry out the initializing process for initializing the drive position by driving the IACV 9 once to the fully opened position at the timing when the ignition switch 7 is turned ON for starting the engine. With such setting, the initializing process of the IACV 9 is completed in the minimum time period. In contrast, when the cranking is started immediately after having turned ON the ignition switch 7, the cranking is carried out during the initializing process, that is, in a state in which the IACV 9 is opened.

Therefore, the intake pressure of the engine may be dropped significantly in a state in which the number of engine revolution is still low after having started the cranking. At this time, in the method in which the Th—FI map 510 is used until the stroke determination is settled, the drop of the intake pressure of the engine is not reflected to the amount of fuel injection, so that the air-fuel mixture at the time of starting the engine is brought into an overlain state, and hence the number of engine revolution may be unstable.

In contrast, according to the engine control apparatus in this embodiment, since the group injection based on the Pb detected value is carried out at a time point when the stroke determination is provisionally settled, a significant change in intake pressure due to the initializing process of the IACV 9 is accommodated, so that the fuel injection control in an adequate amount is enabled. Accordingly, stabilization of the number of engine revolution at the time of starting is achieved in spite of being set to IACV 9.

The configurations of the engine, the ECU, the Pb sensor, the IACV, and so on, the style of the Pb—FI map and the Th—FI map, the position and the number of the cylinders to which the Pb sensor is connected for obtaining the synthetic manifold pressure waveform, the number of cranking stages for recognizing the Pb pattern, the number of times of continuous recognition of the Pb pattern until the stroke determination, etc. is finally settled are not limited to those in the embodiment shown above, and various modifications can be made.

For example, the range of the provisional cycle stage for calculating the Pb base values Pb1 and Pb2 may be changed as needed according to the type of the engine.

Although the present invention has been described herein with respect to a number of specific illustrative embodiments, the foregoing description is intended to illustrate, rather than to limit the invention. Those skilled in the art will realize that many modifications of the illustrative embodiment could be made which would be operable. All such modifications, which are within the scope of the claims, are intended to be within the scope and spirit of the present invention.

What is claimed is:

1. An engine control method for carrying out a stroke determination for a plurality of cylinders of an engine using a detected value of an engine intake pressure, said engine control method comprising the steps of:

monitoring said engine intake pressure with a pressure detector;

provisionally settling the stroke determination using a first method of stroke determination having a first degree of accuracy;

when the stroke determination is provisionally settled, controlling fuel injection of said engine based on the detected value of the engine intake pressure;

finally settling said stroke determination using a second method of stroke determination having a second degree of accuracy, wherein said second degree of accuracy is greater than said first degree of accuracy; and after the stroke determination is finally settled, controlling fuel injection and ignition of the engine based on the detected value of the engine intake pressure.

2. The engine control method according to claim 1, characterized in that:

the provisional settlement of said stroke determination is achieved by repeating a pattern recognition of a waveform of the intake pressure a first predetermined number of times; and the final settlement of said stroke determination is achieved by repeating a pattern recognition of a waveform of the intake pressure a second predetermined number of times;

wherein the second predetermined number of times is greater than the first predetermined number of times.

3. The engine control method according to claim 2, characterized in that:

when the stroke determination is provisionally settled, fuel is simultaneously injected into synchronous cylinders, based on the detected value of the intake pressure; and when the stroke determination is finally settled, fuel is independently and sequentially injected into each of the plurality of cylinders, based on the detected value of the intake pressure.

4. The engine control method according to claim 2, further comprising a step of buffering the detected values of the intake pressure from a start of cranking of the engine;

wherein the method is characterized in that the stroke determination is provisionally settled at a time point when a crankshaft has rotated by 720 degrees from a time point when a crank reference position of the engine is settled;

and that the buffered detected values of the intake pressure are related to provisional cycle stages turned out in the provisional settlement at a time point when the stroke determination is provisionally settled, so that the fuel injection control using the buffered detected values of the intake pressure is enabled at said time point of the provisional settlement.

5. The engine control method according to claim 4, characterized in that:

when the stroke determination is provisionally settled, a group injection for injecting fuel to synchronous cylinders is simultaneously carried out based on the detected value of the intake pressure, and when the stroke determination is finally settled, a sequential injection for injecting fuel for each cylinder is carried out based the detected value of the intake pressure.

6. The engine control method according to claim 2, further comprising a step of controlling a number of idling revolutions of the engine using an idle air control valve controlled by an idle air control valve control unit, wherein the idle air control valve control unit initially drives the idle air control valve to a fully opened position at a time point when an ignition switch is turned ON.

7. The engine control method according to claim 1, characterized in that:

when the stroke determination is provisionally settled, fuel is simultaneously injected into synchronous cylinders, based on the detected value of the intake pressure; and when the stroke determination is finally settled, fuel is independently and sequentially injected into each of the plurality of cylinders, based on the detected value of the intake pressure.

8. The engine control method according to claim 7, further comprising a step of buffering the detected values of the intake pressure from start of cranking of the engine;

wherein the method is characterized in that the stroke determination is provisionally settled at a time point when a crankshaft has rotated by 720 degrees from a time point when a crank reference position of the engine is settled;

and that the buffered detected values of the intake pressure are related to provisional cycle stages turned out in the provisional settlement at a time point when the stroke determination is provisionally settled, so that the fuel injection control using the buffered detected values of the intake pressure is enabled at said time point of the provisional settlement.

9. The engine control method according to claim 7, further comprising a step of controlling a number of idling revolutions of the engine using an idle air control valve controlled by an idle air control valve control unit, wherein the idle air control valve control unit initially drives the idle air control valve to a fully opened position at a time point when an ignition switch is turned ON.

10. The engine control method according to claim 1, further comprising a step of buffering the detected values of the intake pressure from a start of cranking of the engine;

wherein the method is characterized in that the stroke determination is provisionally settled at a time point when a crankshaft has rotated 720 degrees from a time point when a crank reference position of the engine is settled;

and that the buffered detected values of the intake pressure are related to provisional cycle stages turned out in the provisional settlement at a time point when the stroke determination is provisionally settled, so that fuel injection control using the buffered detected values of the intake pressure is enabled at said time point of the provisional settlement.

11. The engine control method according to claim 10, characterized in that:

when the stroke determination is provisionally settled, a group injection for injecting fuel to synchronous cylinders is simultaneously carried out based on the detected value of the intake pressure, and when the stroke determination is finally settled, a sequential injection for injecting fuel for each cylinder is carried out based the detected value of the intake pressure.

12. The engine control method according to claim 11, further comprising a step of controlling a number of idling revolutions of the engine using an idle air control valve controlled by an idle air control valve control unit, wherein the idle air control valve control unit initially drives the idle air control valve to a fully opened position at a time point when an ignition switch is turned ON.

13. The engine control method according to claim 10, further comprising a step of controlling a number of idling revolutions of the engine using an idle air control valve controlled by an idle air control valve control unit, wherein the idle air control valve control unit initially drives the idle air control valve to a fully opened position at a time point when an ignition switch is turned ON.

14. The engine control method according to claim 1, further comprising a step of controlling a number of idling revolutions of the engine using an idle air control valve controlled by an idle air control valve control unit, wherein the idle air control valve control unit initially drives the idle air control valve to a fully opened position at a time point when an ignition switch is turned ON.

15. An engine control method for a 4-cycle 4-cylinder engine, said method comprising the steps of monitoring an intake pressure of the engine;

detecting a crank pulse after starting of the engine;

determining a crank reference position;

provisionally settling stroke determination of cylinders of said engine after one cycle rotation of a crankshaft of the engine after said settling of said crank reference point; finally settling said stroke determination of said cylinders after two cycle rotation of the crankshaft after said provisional settlement of said stroke determination;

when the stroke determination is provisionally settled, controlling fuel injection of said engine based on the monitored value of the engine intake pressure; and when the stroke determination is finally settled, controlling said fuel injection and an ignition of the engine based on the monitored value of the engine intake pressure.

16. An engine control method according to claim 15, wherein:

when the stroke determination is provisionally settled, fuel is simultaneously injected into synchronous cylinders, based on the detected value of the intake pressure; and when the stroke determination is finally settled, fuel is independently and sequentially injected into each of the plurality of cylinders, based on the detected value of the intake pressure.

17. An engine control method according to claim 15, further comprising a step of controlling a number of idling revolutions of the engine using an idle air control valve controlled by an idle air control valve control unit, wherein the idle air control valve control unit initially drives the idle air control valve to a fully opened position at a time point when an ignition switch is turned ON.

18. An engine control method for a 4-cycle 4-cylinder engine, said method comprising the steps of monitoring engine intake pressure;

detecting a crank pulse after starting of the engine;

settling a crank reference position after 360 degree of rotation of a crankshaft of the engine;

provisionally settling stroke determination of cylinders of said engine after 720 degrees rotation of the crankshaft of the engine after said settling of said crank reference point; finally settling said stroke determination of said cylinders after 1440 degrees rotation of the crankshaft after said provisional settlement of said stroke determination;

when the stroke determination is provisionally settled, controlling fuel injection of said engine based on the monitored value of the engine intake pressure; and when the stroke determination is finally settled, controlling said fuel injection and an ignition of the engine based on the monitored value of the engine intake pressure;

wherein the provisional settlement of said stroke determination is achieved by repeating a pattern recognition of the waveform of the engine intake pressure by a first predetermined number of times;

the final settlement of said stroke determination is achieved by repeating a pattern recognition of a waveform of the engine intake pressure by a second predetermined number of times; and wherein said first predetermined number of times is less than the second predetermined number of times.

19. An engine control method according to claim 18, wherein:

when the stroke determination is provisionally settled, fuel is simultaneously injected into synchronous cylinders, based on the detected value of the intake pressure; and when the stroke determination is finally settled, fuel is independently and sequentially injected into each of the plurality of cylinders, based on the detected value of the intake pressure.

20. An engine control method according to claim 18, further comprising a step of controlling a number of idling revolutions of the engine using an idle air control valve controlled by an idle air control valve control unit, wherein the idle air control valve control unit initially drives the idle air control valve to a fully opened position at a time point when an ignition switch is turned ON.

* * * * *